United States Patent [19]

Stauth

[11] 4,101,088

[45] Jul. 18, 1978

[54] MANUAL IMPACT STAKE DRIVING APPARATUS

[76] Inventor: Tommy E. Stauth, 110 Plaza Ave., Dodge City, Kans. 67801

[21] Appl. No.: 726,527

[22] Filed: Sep. 27, 1976

[51] Int. Cl.[2] ..... B65H 75/34; B65H 75/28; B25D 1/04

[52] U.S. Cl. ..... 242/85; 30/277; 173/91; 242/100; 242/125.2

[58] Field of Search ..... 242/85, 85.1, 100, 54 R, 242/125.2; 173/132, 133, 91; 33/86, 138, 293; 30/277, 164.6; 81/52.35

[56] References Cited

U.S. PATENT DOCUMENTS

| | | | |
|---|---|---|---|
| 1,082,379 | 12/1913 | West | 30/277 |
| 2,236,305 | 2/1941 | Ahlin | 242/100 |
| 2,485,877 | 10/1949 | Hamilton, Jr. | 30/277 |
| 2,923,335 | 2/1960 | Joyce | 173/91 X |
| 3,036,482 | 5/1962 | Kenworthy et al. | 30/277 |
| 3,211,240 | 10/1965 | Smitter et al. | 173/132 X |
| 3,313,356 | 4/1967 | Clevenger | 173/91 |
| 3,381,763 | 5/1968 | Matson | 173/132 X |
| 3,817,471 | 6/1974 | Finneman | 242/85.1 |

*Primary Examiner*—George F. Mautz
*Attorney, Agent, or Firm*—Cook, Wetzel & Egan, Ltd.

[57] ABSTRACT

The disclosure relates to an improved manual impact apparatus for driving a stake of the type having a head at one end thereof, which apparatus is characterized by a slidable sleeve having oppositely disposed and facing impact stops therein to confine the stake head therebetween during driving or pulling, whereby the stake may be longitudinally propelled in response to impact between one of the impact stops and the stake head.

1 Claim, 4 Drawing Figures

MANUAL IMPACT STAKE DRIVING APPARATUS

BACKGROUND OF THE INVENTION

The present invention is directed generally to impact driving means and more particularly to an improved manual impact stake driving apparatus and to the combination thereof with a stake.

Certain difficulties have been associated with prior art devices for driving stakes such as for example are used to anchor watercraft or tents. Prior art stake driving tools have had the disadvantages of being heavy and unwieldy, and in many cases have required an inordinate amount of physical strength to operate, which has operated to the detriment and unsafety of women and younger mariners and campers.

Additionally, some prior art stake driving devices have been of otherwise less than safe construction, which has reduced their commercial acceptance by those skilled in the art and especially by consumer groups.

In view of these and other difficulties associated with the prior art, it is an object of the improved manual impact stake driving apparatus of the present invention materially to alleviate these difficulties.

It is an additional object of the present invention to provide, in combination with a stake, an improved manual impact stake driver which provides for simplicity of construction, ease and efficiency of use, and safety of operation to the user.

SUMMARY OF THE INVENTION

The improved manual stake driver and stake combination in accordance with the present invention comprises in general a slidable sleeve which may be disposed for use on the shaft of a stake having a head portion when in disposition for use, the stake head is confined between upper and lower impact stops carried by the sleeve. The lower impact stop has an opening therein for sliding relating to the stake shaft. The stake driver is used to drive such a stake by placing the point of an engaged stake against the surface into which it is to be driven and sliding the sleeve upwardly, but not to substantially impact the stake head with the lower impact stop. The slidable sleeve is then pushed downwardly to cause a substantial impact between the stake head and the upper impact stop of the sleeve, thereby to propel the stake downwardly and into the surface. Those steps are repeated until the stake is driven the desired distance into the surface.

Conversely, the stake may be removed from the ground by a motion reciprocating to the above to cause repeated substantial impact of the lower impact stop with the stake head confined in the sleeve, thereby to cause upward movement of the stake from the surface into which it had been driven.

In one embodiment of the present invention the stake head is permanently confined between the two impact stops and the slidable sleeve. That embodiment may be useful for applications wherein the driving of a single stake may be satisfactory, such as for example stakes used in the anchoring of marine craft. In that embodiment a flange may be provided at the lower surface of the sleeve for engagement of the flange with the ground to limit the distance into the ground in which the stake may be driven. Also, the slidable sleeve may be rotatable about the stake, in which case a line hook may be provided preferably on the flange to prevent rotation of the spool and hence paying out of the line which would be caused by a force directed against the line.

In another preferred embodiment of the present invention the sleeve may be provided with means for initially engaging a removable stake for driving and for removing the driver from the stake after driving the stake into the surface. This embodiment is useful particularly in applications such as the driving of the multiple stakes necessary for securing a camper's tent. The lower portion of the sleeve may be provided with aperture means therein near the lower impact stop to permit the head of the stake to be introduced into the sleeve. Slot means are provided which communicate the aperture in the sleeve wall with the opening in the lower impact stop for accommodating the stake shaft during fitting of the stake head into the sleeve. By providing such aperture and slot means communicating with the opening in the lower impact stop, a stake may be engaged on the stake driver, driven, and then the stake driver may be removed for driving another stake.

In a further preferred embodiment of the present invention a stake-extending rod is provided to slide within and engage the sleeve at on end. Such rod is attached at its other end to the stake head in order that the stake may be driven completely into the ground.

Various other modifications of the present invention are intended to be embodied and will become apparent to those skilled in the art from the teaching of the principles of the invention in connection with the disclosure of the specification, the claims and the drawing.

DETAILED DESCRIPTION OF THE PREFERRED EMBODIMENT

Figure 1:
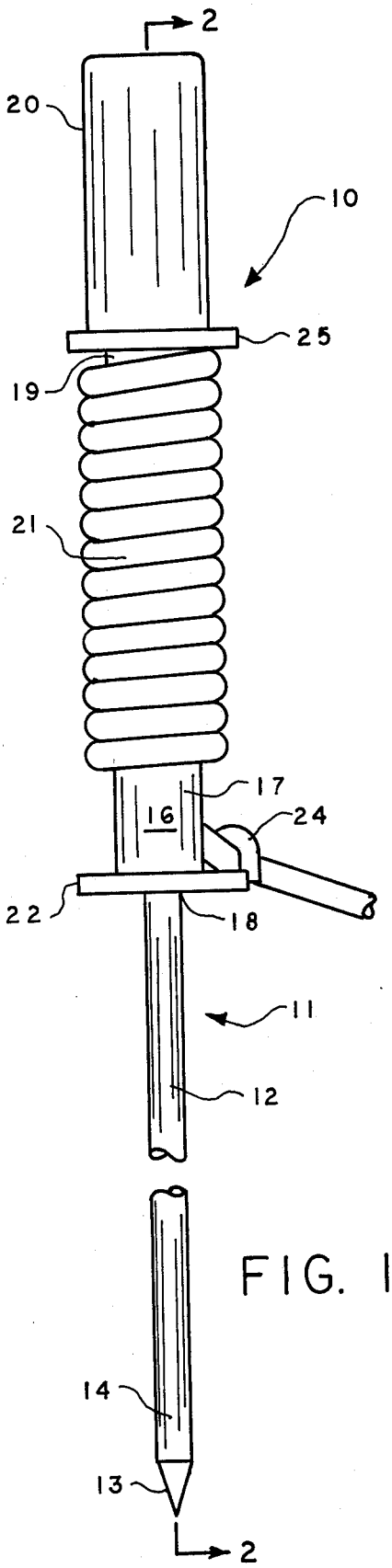
FIG. 1 is a side elevational view of a one preferred embodiment of the manual impact stake driver in combination with a non-removable stake, including a handle, a spool for storing line unitary with the slidable sleeve, a lower flange for limiting the penetration of the stake into the ground, and a line hook attached to the lower flange to prevent rotation of the line spool and paying out of the line caused by a force on the line.

The present invention combines a stake and a manual impact stake driver. The stake has a shaft with a piercing point at one end thereof, and a head at the other end of the shaft, the head having upper and lower impact surfaces. The stake driver comprises a slidable sleeve which is disposable about the portion of the stake shaft including the stake head. Upper impact stop means are provided on the sleeve for impacting with the upper impact surface of the stake head when the sleeve is propelled longitudinally in a downward direction. A lower impact stop means is provided on the sleeve for contact with the lower impact surface of the stake head when the slidable sleeve is propelled in a reciprocal longitudinal direction. Such lower impact stop means includes an opening to permit sliding of the stake shaft therethrough.

The stake head is slidably confined between such upper and lower impact stop means in order that the stake may be driven in response to the impact between the upper impact surface on the stake head and the upper impact stop on the sleeve, and after driving, the stake may be pulled in response to the impact between the lower impact surface of the head and the lower impact stop means on the sleeve. Thus, the user operates the stake driver by placing the point of the stake against the ground surface and sliding the sleeve reciprocally upwards a small distance and then propelling the sleeve forcibly downwardly to provide substantial impact between the upper impact stop on the sleeve and the upper impact area on the head of the stake. Pulling of the stake is accomplished by reciprocal motion. Preferably a handle connected to the sleeve is provided.

In one preferred embodiment a flange is disposed on the exterior of the sleeve for restricting the depth to which the stake may be driven in the ground surface. In embodiments where the sleeve is rotatable, spool means may be provided for storage of a quantity of line. Preferred embodiments may also include a means for restraining the rotation of the spool. One such preferred embodiment includes a line hook attached to the flange for that purpose.

In another preferred embodiment of the manual impact stake driver of the present invention, the slidable sleeve has an aperture therein in a portion of the sleeve wall between the upper and lower impact areas and near to the lower impact stop area. The aperture is of sufficient size to permit engagement and disengagement of the head of a removable stake with the sleeve and such aperture is connected to the opening in the lower impact stop by a slot to permit passage of the stake shaft into the opening such that, after the stake is driven, the stake driver may be removed for driving another stake.

In a further preferred embodiment of a manual impact stake driver in accordance with the present invention, the driver is provided with a stake-extending rod for operatively connecting the lower end thereof to the stake, thereby to extend the effective length of the stake during driving, such that the stake may be driven completely into the surface. The stake-extending rod has an impact head disposed at the opposite end thereof, which is contained within the slidable sleeve and between the upper and lower impact stop means on the sleeve. The stake is driven in response to repeated, substantial, longitudinal propulsion of the sleeve, to provide impact between the upper impact stop area on the sleeve and the upper impact area on the rod. After driving, the stake may be pulled by reciprocal, repeated, substantial propulsion of the sleeve, to provide impact between the lower impact stop means on the sleeve and the lower impact area on the rod. In an preferred embodiment the sleeve contains a longitudinal slot and the rod has a mating pin for engagement with the slot, with the pin sliding in the slot to define maximum and minimum longitudinal limits for the sliding movement of the rod within the sleeve.

Referring now to the drawings and to FIG. 1 in particular, the manual impact stake driver shown generally at 10 is utilized in connection with a stake generally designated as 11. Stake 11 comprises a shaft 12 with a point 13 disposed at one end 14. Stake shaft 12 is preferably cylindrical but other configurations may be used. Driver 10 preferably comprises a slidable sleeve 16 disposed upon the stake shaft 12 at one end 17 of sleeve 16, which end 17 contains an opening 18 for reciprocating movement of the sleeve 16 on the shaft 12. Disposed at the opposite end 19 of the sleeve 16 preferably is a handle 20, although the sleeve 16 itself may in some embodiments serve as a handle. Sleeve 16 may be rotational or non-rotational in alternative embodiments. A rotational sleeve may be utilized, for example, as a spool for containing a quantity of line 21. Also, in one preferred embodiment the sleeve 16 includes a flange 22 to limit the depth to which stake 11 may be driven. Preferably a means for limiting rotation of the sleeve 16 as would be caused by a force directed against line 21 is provided. A preferred means for limiting such rotation is shown in the form of a line hook 24, which may be attached to the flange 22. An upper flange 25 may also be provided to provide a storage area for line 21 to define thereby the line spool.

Figure 2:
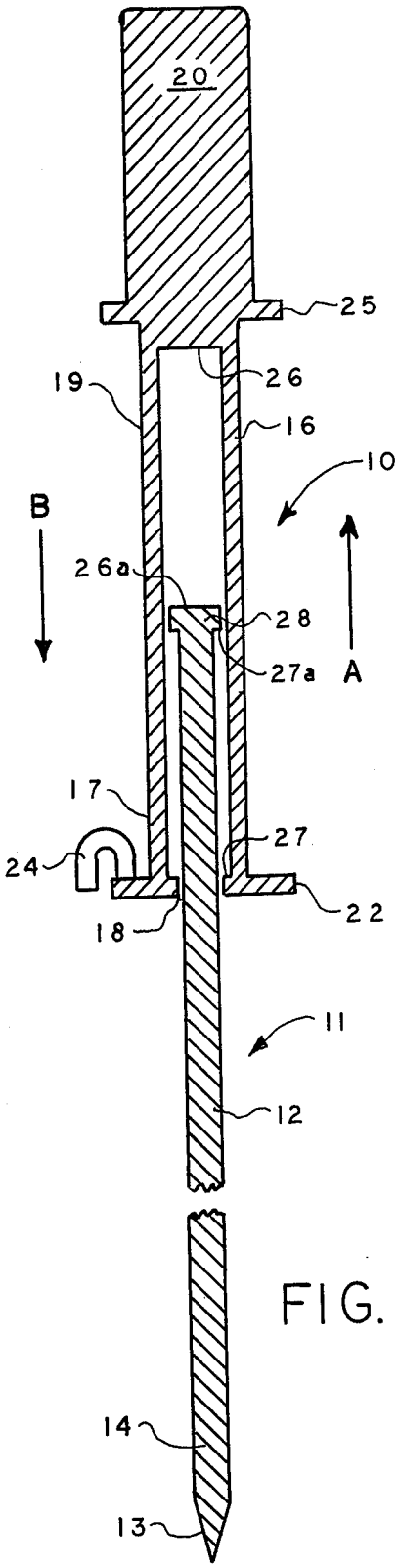
FIG. 2 is a cross-sectional view taken on line 2—2 of FIG. 1 showing such preferred embodiment.

Referring now to FIG. 2, which is a cross-sectional view along line 2 — 2 of the embodiment shown in FIG. 1, the internal portion of slidable sleeve 16 and its functioning in conjunction with stake 11 may be seen. Slidable sleeve 16 may be reciprocated in an upward direction, as shown by arrow A, and propelled downwardly on shaft 12 of stake 11 as shown by arrow B. Sleeve 16 carries upper and lower impact stop means 26, 27 respectively oppositely disposed and facing each other at ends 19, 17 respectively of said sleeve. Lower impact stop means 27 preferably includes the opening 18 integrally therewith to permit the sliding of sleeve 16 upon the stake shaft 12. Head 28 of stake 11 has a cross-sectional linear dimension greater than that of opening 18 whereby stake head 28 is prevented from exiting sleeve 16 during such upward sliding of sleeve 16 on the stake shaft 12. Stake head 28 is further characterized by upper and lower impact surfaces *26a, 27a* for impacting engagement with upper and lower impact stop means 26, 27 respectively at opposite ends 19, 17 respectively of the sleeve.

Figure 3:
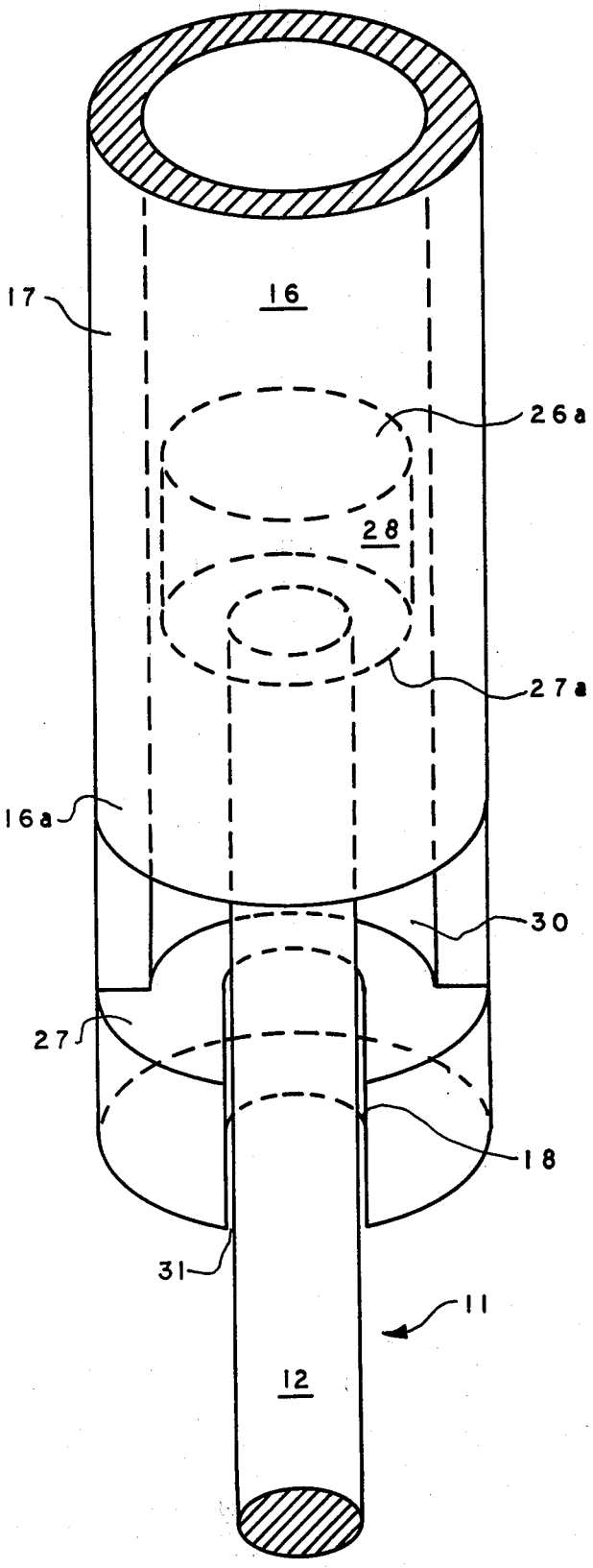
FIG. 3 is an enlarged view showing the lower portion of the stake head engagement of another preferred embodiment, including aperture and slot means for engaging and disengaging the stake from the stake driver.

Referring now to FIG. 3, which shows the stake driver mechanism as used in an alternative embodiment to permit removal of sleeve 16 from stake 11 after driving stake 11 into the ground or other surface. Sleeve 16 has at lower end portion 17 thereof aperture 30 in the wall *16a* thereof, such aperture 30 of sufficient size to permit insertion of the stake head 28 and which aperture 30 communicates with a slot 31 in the lower impact stop means 27 of sleeve 16. Slot 31 further communicates with opening 18 in lower impact stop means 27 in order that shaft 12 of stake 11 may be functionally accommodated into such opening 18 for concentric fitting with the sleeve for sliding disposition, as described above in connection with FIGS. 1 and 2.

Figure 4:
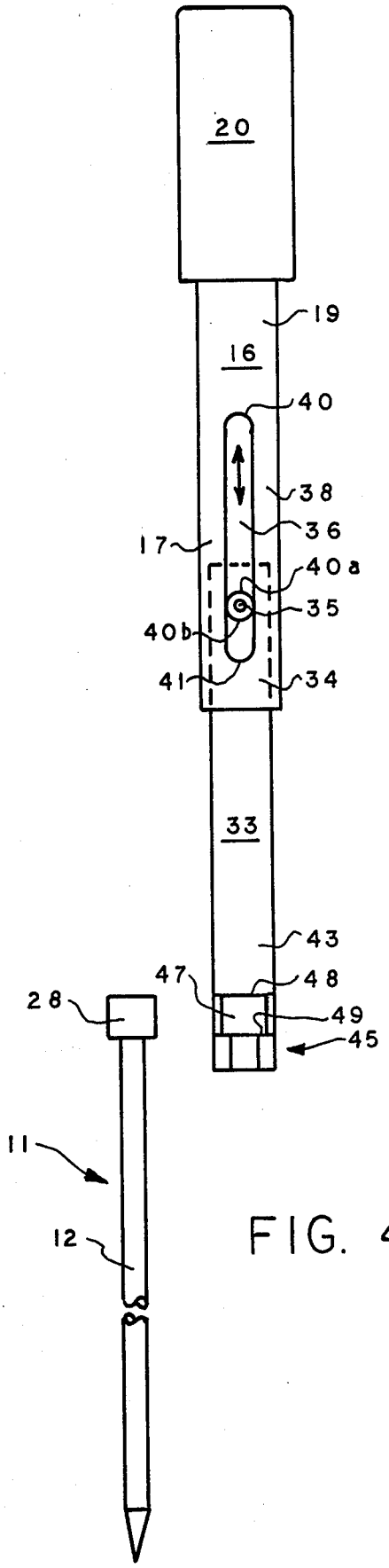
FIG. 4 is a side elevational view of a further preferred embodiment of the present invention showing a stake-extending rod means disposed within the slidable sleeve, the rod having a pin mating and engaging a slot in the sleeve to provide maximum and minimum impact stop limits for reciprocation of the stake-extending rod and means oppositely disposed on said rod for detachably securing the stake head to the stake-extending rod, whereby the stake head may be driven completely flush with the surface.

Referring now to the alternative embodiment of FIG. 4, sleeve 16 likewise may have at an upper end 19 a handle 20, but lower end 17 is adopted for engagement with a stake-extending rod 33. Stake-extending rod 33 preferably has at a top portion 34 thereof a pin 35 for mating with a slot 36 disposed longitudinally in side wall 38 of sleeve 16, to define thereby maximum and minimum limits between which rod 33 may reciprocate. In an alternative embodiment (not shown), a rod head may be provided to slide between two oppositely disposed and facing impact stop means, as described above in connection with the mechanism shown in FIGS. 1, 2, and 3. Upper and lower slot impact stop surfaces 40, 41 are defined by the extremities of longitudinal slot 36 and mating impact surfaces 40*a*, 41*a* on rod 33 are defined preferably by a transversely disposed pin 35.

At the opposite end 43 of rod 33 a connecting means (generally shown at 45) for operatively connecting rod 33 to the stake shaft head 28 are depicted. The connecting means preferably utilized may be a structure analogous to the aperture, slot and opening means shown in FIG. 3 which permit insertion and removal of the stake-head therefrom, the structural difference being that in the embodiment shown in FIG. 4 a head confining means 47 is provided to prevent any upward movement of the head 28. Head confining means 47 may take the form of a niche defining top stop 48 which, in conjunction with the lower stop 49, securely and snugly holds head 29 therebetween.

The materials used to construct the above elements is preferably a strong metal, such as steel, although other sufficiently strong materials may be utilized. Manual impact stake driving devices in accordance with the present invention may be made in a variety of sizes and shapes in keeping with the teachings of the present invention. However, drivers having a length of approximately 12 inches have proved acceptable in actual use. The weight of the driver may vary in different embodiments, but should preferably be of sufficient mass to provide and transfer a substantial momentum to the driver stake. The stake utilized in combination with the driver is of a suitable, compatible length and stakes of 16 to 20 inches have proved acceptable in actual use.

The basic and novel characteristics of the present invention and the advantages thereof will be readily understood from the foregoing disclosure by those skilled in the art. It will become readily apparent that various changes and modifications may be made in the form, construction and arrangement of the combination apparatus set forth hereinabove without departing from the spirit and scope of the invention. Accordingly, the preferred and alternative embodiments of the present invention set forth hereinabove are not intended to limit such spirit and scope in any way.

What is claimed is:

1. A manually driven, removable stake apparatus for anchoring and securing watercraft at an adjustable distance therefrom, said stake apparatus comprising in combination:

a stake having a piercing point at one end thereof and a driving and pulling stake head at the opposite end thereof, said stake head having upper and lower impact surfaces thereon;

sleeve means having upper and lower impact stops at opposite ends thereof for slidably confining said stake head therebetween, whereby said stake may be manually driven into a surface in response to impact between the upper impact surface of said stake head and the upper impact stop of said sleeve means, and may be manually pulled from such surface in response to impact between the lower impact surface of said stake and the lower impact stop of said sleeve means;

flange means disposed radially on said sleeve means for restricting the depth to which said stake may be driven in such surface;

a quantity of line storable on said sleeve means;

means on said sleeve means defining spool means for rotationally receiving and storing said line thereon; and line hook means secured to and carried by said sleeve means for hooking about said line to prevent, during periods of pulling force against said line, rotation of said sleeve means and thereby to prevent paying out of said hooked line.

* * * * *